US010629150B2

(12) United States Patent
Chen

(10) Patent No.: US 10,629,150 B2
(45) Date of Patent: Apr. 21, 2020

(54) AMOLED PIXEL DRIVING CIRCUIT AND PIXEL DRIVING METHOD

(71) Applicant: SHENZHEN CHINA STAR OPTOELECTRONICS TECHNOLOGY CO., LTD., Guangdong (CN)

(72) Inventor: Shuai Chen, Guangdong (CN)

(73) Assignee: SHENZHEN CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 148 days.

(21) Appl. No.: 15/577,773

(22) PCT Filed: Aug. 9, 2017

(86) PCT No.: PCT/CN2017/096539
§ 371 (c)(1),
(2) Date: Nov. 29, 2017

(87) PCT Pub. No.: WO2018/223519
PCT Pub. Date: Dec. 13, 2018

(65) Prior Publication Data

US 2019/0051262 A1 Feb. 14, 2019

(30) Foreign Application Priority Data

Jun. 7, 2017 (CN) ..... 2017 1 0424119

(51) Int. Cl.
*G09G 3/36* (2006.01)

(52) U.S. Cl.
CPC ..... *G09G 3/3677* (2013.01); *G09G 3/3674* (2013.01); *G09G 2310/0289* (2013.01);
(Continued)

(58) Field of Classification Search
CPC ..... G09G 3/3677; G09G 3/3674; G09G 2310/06; G09G 2310/08; G09G 2320/045; G09G 2310/0289; G09G 2330/04
See application file for complete search history.

(56) References Cited

U.S. PATENT DOCUMENTS

2015/0279288 A1* 10/2015 Dai ..... G02F 1/13306 345/690
2016/0125830 A1* 5/2016 Xiao ..... G09G 3/3677 345/92

(Continued)

FOREIGN PATENT DOCUMENTS

CN 105469761 A 4/2016
CN 106128379 A 11/2016

(Continued)

*Primary Examiner* — Grant Sitta
(74) *Attorney, Agent, or Firm* — Mark M. Friedman

(57) ABSTRACT

The present disclosure provides a GOA driving circuit and a liquid display panel. The GOA driving circuit comprises a plurality of cascaded GOA units. An N-th GOA unit comprises a pull-up module, a pull-down module, a pull-up control module, a pull-down holding module, and a bootstrap capacitor module. The pull-up module, the pull-down module, the pull-down holding module, and the bootstrap capacitor module couple to an N-th gate signal node Qn.

11 Claims, 2 Drawing Sheets

(52) U.S. Cl.
CPC ..... *G09G 2310/06* (2013.01); *G09G 2310/08* (2013.01); *G09G 2320/045* (2013.01)

(56) References Cited

U.S. PATENT DOCUMENTS

| | | | | |
|---|---|---|---|---|
| 2016/0126947 | A1* | 5/2016 | Xiao | G09G 3/3655 327/109 |
| 2016/0126948 | A1* | 5/2016 | Xiao | G09G 3/3677 327/109 |
| 2016/0260403 | A1* | 9/2016 | Dai | G09G 3/36 |
| 2016/0275887 | A1* | 9/2016 | Xiao | G09G 3/3648 |
| 2016/0284293 | A1* | 9/2016 | Dai | G09G 3/36 |
| 2016/0284296 | A1 | 9/2016 | Dai | |
| 2016/0284303 | A1* | 9/2016 | Dai | G09G 3/36 |
| 2016/0307535 | A1 | 10/2016 | Xiao | |
| 2016/0343322 | A1* | 11/2016 | Xiao | H01L 27/1255 |
| 2016/0351152 | A1* | 12/2016 | Dai | G09G 3/3677 |
| 2016/0358572 | A1* | 12/2016 | Xiao | G11C 19/287 |
| 2016/0358666 | A1* | 12/2016 | Pang | G11C 19/287 |
| 2017/0010731 | A1* | 1/2017 | Zhang | G11C 19/28 |
| 2017/0092214 | A1* | 3/2017 | Xiao | G09G 3/3677 |
| 2017/0102805 | A1* | 4/2017 | Xiao | G06F 3/044 |
| 2018/0047759 | A1 | 2/2018 | Zhao et al. | |
| 2018/0182334 | A1 | 6/2018 | Li | |
| 2018/0231818 | A1 | 8/2018 | Cao et al. | |

FOREIGN PATENT DOCUMENTS

| | | | | |
|---|---|---|---|---|
| CN | 106128392 | A | 11/2016 | |
| CN | 106328084 | A | 1/2017 | |
| WO | WO-2016008189 | A1 * | 1/2016 | G09G 3/36 |
| WO | WO-2016070510 | A1 * | 5/2016 | H01L 27/1255 |

* cited by examiner

AMOLED PIXEL DRIVING CIRCUIT AND PIXEL DRIVING METHOD

FIELD OF INVENTION

The present disclosure relates to the field of liquid crystal display, and more particularly to a GOA driving circuit and a liquid display panel.

BACKGROUND OF INVENTION

The concept of gate driver on array (GOA) is integrated a gate driving circuit of a TFT LCD on a glass substrate to drive the scanning of a liquid display panel. In comparison with conventional driving technology adapting chip on film (COF), GOA driving technology saves the manufacturing cost greatly and omits the Bonding process of COIF disposed on the side by gate. In the meanwhile, GOA driving technology is advantageous to promote the production capacity.

In general, there are two pull-down holding modules, which are disposed on each cascade of GOA driving circuits, operate by turns in order to prevent circuit failure that caused from a threshold voltages positive shifting of a switching transistor after the switching transistor of the pull-down modules encounter positive bias stress (PBS). However, in fact, positive shifting, about 10V, still remains and affects the threshold voltage Vth of the switching transistor in the pull-down module. This situation affects stability of the switching transistor and will affect display stability of liquid crystal panel.

Therefore, defects of present technology urgently require improvement.

SUMMARY OF INVENTION

The object of this disclosure provides a GOA driving circuit and liquid crystal display to enhance the stability of the liquid crystal panel.

To solve the above-mentioned technical problems, the present disclosure provides a GOA driving circuit which comprises: a plurality of cascaded GOA units, an N-th GOA unit outputting a gate driving signal to an N-th horizontal scanning line of a display area, wherein the N-th GOA unit comprises a pull-up module, a pull-down module, a pull-up control module, a pull-down holding module, and a bootstrap capacitor module; the pull-up module, the pull-down module, the pull-down holding module, and the bootstrap capacitor module couple to an N-th gate signal node Qn and an N-th horizontal scanning line Gn; the pull-up module couples to the N-th gate signal node Qn;

the pull-down holding module comprises a first pull-down holding unit and a second pull-down holding unit;

the first pull-down holding unit comprises a first switching transistor, a second switching transistor, a third switching transistor, a fourth switching transistor, a fifth switching transistor, a sixth switching transistor, and a first capacitor;

a control end of the first switching transistor, an input end of the first switching transistor, an input end of the second switching transistor, and one end of the first capacitor receive a first clock signal; an output end of the first switching transistor and a control end of the second switching transistor couple to an input end of the third switching transistor; an output end of the second switching transistor, another end of the first capacitor, an input end of the fourth switching transistor, a control end of the fifth switching transistor, and a control end of the sixth switching transistor couple to a first node K, a control end of the third switching transistor couples to a control end of the fourth switching transistor and the N-th gate signal node Qn; an output and of the third switching transistor, an output end of the fifth switching transistor and an output end of the sixth switching transistor couple to a first voltage line Vss, an output end of the fourth switching transistor couples to a second voltage line L1; an input end of the fifth switching transistor couples to the N-th horizontal scanning line Gn, and an input end of the sixth switching transistor couples to the N-th gate signal node Qn;

the second pull-down holding unit comprises a seventh switching transistor, an eighth switching transistor, a ninth switching transistor, a tenth switching transistor, an eleventh switching transistor, a twelfth switching transistor, and a second capacitor;

a control end of the seventh switching transistor, an input end of the seventh switching transistor, an input end of the eighth switching transistor, and one end of the second capacitor receive a second clock signal; an output end of the seventh switching transistor and a control end of the eighth switching transistor couple to an input end of the ninth switching transistor; an output end of the eighth switching transistor, another end of the second capacitor, an input end of the tenth switching transistor, a control end of the eleventh switching transistor, and a control end of the twelfth switching transistor couple to a second node P, a control end of the ninth switching transistor and a control end of the tenth switching transistor couple to the N-th gate signal node Qn; an output and of the ninth switching transistor, an output end of the eleventh switching transistor and an output end of the twelfth switching transistor couple to a first voltage line Vss, an output end of the tenth switching transistor couples to a third voltage line L2; an input end of the eleventh switching transistor couples to the N-th horizontal scanning line Gn, and an input end of the twelfth switching transistor couples to the N-th gate signal node Qn.

Preferable, the N-th GOA unit comprises a downlink module comprising a fourteenth switching transistor, an input end of the fourteenth switching transistor receives a clock signal, an output end of the fourteenth switching transistor couples to a control end of a pull-up control module of an (N+2)-th GOA unit, a control end of the fourteenth switching transistor couples to the N-th gate signal node Qn.

Preferable, the pull-up control module comprises a thirteenth switching transistor, an input end of the thirteenth switching transistor couples to an (N−2)-th horizontal scanning line Gn−2, an output end of the thirteenth switching transistor couples to the N-th gate signal node Qn, a control end of the thirteenth switching transistor couples to a output end of a downlink module of an (N−2)-th GOA unit.

Preferable, the pull-down module comprises a sixteenth switching transistor and a seventeenth switching transistor;

an input end of the sixteenth switching transistor couples to the N-th gate signal node Qn, an output end of the sixteenth switching transistor couples to the first voltage line Vss, an input end of the seventeenth switching transistor couples to the N-th horizontal scanning line Gn, an output end of the seventeenth switching transistor couples to the first voltage line Vss;

a control end of the sixteenth switching transistor and a control end of the seventeenth switching transistor couple to a (N+2)-th horizontal scanning line Gn+2.

Preferable, the first clock signal and the second clock signal have a same cycle and opposite phases.

Preferable, a square waveform signal provided by the second voltage line is inverted to a square waveform signal provided by the third voltage line the first clock signal comprises a first low potential and a first high potential; the square waveform signal provided by the second voltage line comprises a second low potential and a second high potential; the square waveform signal is at the second low potential when the first clock signal is at the first low potential; the square waveform signal is at the second high potential when the first clock signal is at the first high potential.

Preferable, the first switching transistor, the second switching transistor, the third switching transistor, the fourth switching transistor, the fifth switching transistor, the sixth switching transistor, the seventh switching transistor, the eighth switching transistor, the ninth switching transistor, the tenth switching transistor, the eleventh switching transistor, and the twelfth switching transistor are thin film transistors.

Preferable, the pull-up module comprises a fifteenth switching transistor, an input and of the fifteenth switching transistor receives the third clock signal, an output end of the fifteenth switching transistor couples to the N-th horizontal scanning line Gn, a control end of the fifteenth switching transistor couples to the N-th gate signal node Qn.

Preferable, a voltage amplitude of the first voltage line is greater than voltage amplitudes of the second voltage line and third voltage line.

The present disclosure further provides a GOA driving circuit which comprises: a plurality of cascaded GOA units, an N-th GOA unit outputting a gate driving signal to an N-th horizontal scanning line of a display area, wherein the N-th GOA unit comprises a pull-up module, a pull-down module, a pull-up control module, a pull-down holding module, and a bootstrap capacitor module; the pull-up module, the pull-down module, the pull-down holding module, and the bootstrap capacitor module couple to an N-th gate signal node Qn and an N-th horizontal scanning line Gn; the pull-up module couples to the N-th gate signal node Qn;

the pull-down holding module comprises a first pull-down holding unit and a second pull-down holding unit;

the first pull-down holding unit comprises a first switching transistor, a second switching transistor, a third switching transistor, a fourth switching transistor, a fifth switching transistor, a sixth switching transistor, and a first capacitor;

a control end of the first switching transistor, an input end of the first switching transistor, an input end of the second switching transistor, and one end of the first capacitor receive a first clock signal; an output end of the first switching transistor and a control end of the second switching transistor couple to an input end of the third switching transistor; an output end of the second switching transistor, another end of the first capacitor, an input end of the fourth switching transistor, a control end of the fifth switching transistor, and a control end of the sixth switching transistor couple to a first node K, a control end of the third switching transistor couples to a control end of the fourth switching transistor and the N-th gate signal node Qn; an output and of the third switching transistor, an output end of the fifth switching transistor and an output end of the sixth switching transistor couple to a first voltage line Vss, an output end of the fourth switching transistor couples to a second voltage line L1; an input end of the fifth switching transistor couples to the N-th horizontal scanning line Gn, and an input end of the sixth switching transistor couples to the N-th gate signal node Qn;

the second pull-down holding unit comprises a seventh switching transistor, an eighth switching transistor, a ninth switching transistor, a tenth switching transistor, an eleventh switching transistor, a twelfth switching transistor, and a second capacitor;

a control end of the seventh switching transistor, an input end of the seventh switching transistor, an input end of the eighth switching transistor, and one end of the second capacitor receive a second clock signal; an output end of the seventh switching transistor and a control end of the eighth switching transistor couple to an input end of the ninth switching transistor; an output end of the eighth switching transistor, another end of the second capacitor, an input end of the tenth switching transistor, a control end of the eleventh switching transistor, and a control end of the twelfth switching transistor couple to a second node P, a control end of the ninth switching transistor and a control end of the tenth switching transistor couple to the N-th gate signal node Qn; an output and of the ninth switching transistor, an output end of the eleventh switching transistor and an output end of the twelfth switching transistor couple to a first voltage line Vss, an output end of the tenth switching transistor couples to a third voltage line L2; an input end of the eleventh switching transistor couples to the N-th horizontal scanning line Gn, and an input end of the twelfth switching transistor couples to the N-th gate signal node Qn;

the N-th GOA unit comprises a downlink module comprising a fourteenth switching transistor, an input end of the fourteenth switching transistor receives a clock signal, an output end of the fourteenth switching transistor couples to a control end of a pull-up control module of an (N+2)-th GOA unit, a control end of the fourteenth switching transistor couples to the N-th gate signal node Qn;

the pull-up control module comprises a thirteenth switching transistor, an input end of the thirteenth switching transistor couples to an (N−2)-th horizontal scanning line Gn−2, an output end of the thirteenth switching transistor couples to the N-th gate signal node Qn, a control end of the thirteenth switching transistor couples to a downlink module of an (N−2)-th GOA unit.

the pull-down module comprises a sixteenth switching transistor and a seventeenth switching transistor;

an input end of the sixteenth switching transistor couples to the N-th gate signal node Qn, an output end of the sixteenth switching transistor couples to the first voltage line Vss, an input end of the seventeenth switching transistor couples to the N-th horizontal scanning line Gn, an output end of the seventeenth switching transistor couples to the first voltage line Vss;

a control end of the sixteenth switching transistor and a control end of the seventeenth switching transistor couple to an (N+2)-th horizontal scanning line Gn+2.

The present disclosure further comprises a liquid crystal display device comprising any one of the above-mentioned GOA driving circuits.

Therefore, by disposing the first capacitor and the second capacitor on the first pull-down holding unit and the second pull-down holding unit, improving the present.

DETAILED DESCRIPTION OF PREFERRED EMBODIMENTS

Figure 1:
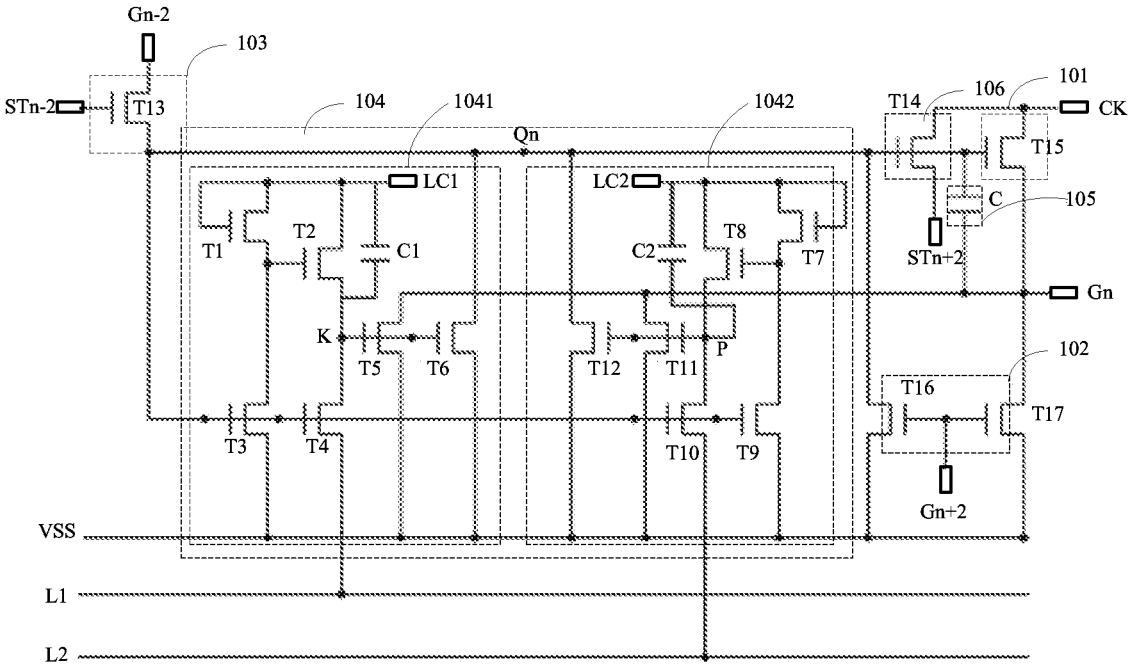
FIG. 1 illustrates a structure of a preferable embodiment of the GOA driving circuit.

The illustrations of the following embodiments take the attached drawings as reference to indicate the applicable specific examples of the present disclosure. The mentioned directional terms, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto. Units having similar structures are numbered the same.

In the drawings, the similar modules are numbered in the same reference numbers.

Please refer to FIG. 1 which illustrate preferable embodiment of a GOA driving circuit comprising a plurality of cascaded GOA units. The GOA units output a gate driving signal to an N-th horizontal scanning line of a display area. The N-th GOA unit comprises a pull-up module 101, a pull-down module 102, a pull-up control module 103, a pull-down holding module 104, and a bootstrap capacitor module 105. The pull-up module 101, the pull-down module 102, the pull-down holding module 104, and the bootstrap capacitor module 105 couple to an N-th gate signal node Qn and an N-th horizontal scanning line Gn. The pull-up module 103 couples to the N-th gate signal node Qn.

In some embodiments, the N-th GOA units further comprise a downlink module comprising a fourteenth switching transistor T14, an input end of the fourteenth switching transistor T14 receives a third clock signal CK. An output end of the fourteenth switching transistor T14 couples to a control end of a pull-up control module 103 of an (N+2)-th GOA unit. A control end of the fourteenth switching transistor T14 couples to the N-th gate signal node Qn.

The pull-up module 101 is mainly utilized for raising the potential of the N-th horizontal scanning line Gn. The pull-up module 101 comprises a fifteenth switching transistor T15. An input and of the fifteenth switching transistor T15 receives the third clock signal CK. An output end of the fifteenth switching transistor T15 couples to the N-th horizontal scanning line Gn. A control end of the fifteenth switching transistor T15 couples to the N-th gate signal node Qn.

The pull-down module 102 is mainly utilized for leveling down the voltage of the N-th gate signal node Qn, and the leveling down the voltage between the N-th horizontal scanning line and the first voltage line Vss. the pull-down module 102 comprises a sixteenth switching transistor T16 and a seventeenth switching transistor T17. An input end of the sixteenth switching transistor T16 couples to the N-th gate signal node Qn. An output end of the sixteenth switching transistor T16 couples to the first voltage line Vss. An input end of the seventeenth switching transistor T17 couples to the N-th horizontal scanning line Gn. An output end of the seventeenth switching transistor T17 couples to the first voltage line Vss. A control end of the sixteenth switching transistor T16 and a control end of the seventeenth switching transistor T17 couple to a (N+2)-th horizontal scanning line Gn+2.

The pull-up control module 103 comprises a thirteenth switching transistor T13. An input end of the thirteenth switching transistor T13 couples to an (N−2)-th horizontal scanning line Gn−2. An output end of the thirteenth switching transistor T13 couples to the N-th gate signal node Qn. A control end of the thirteenth switching transistor T13 couples to a output end of a downlink module 106 of an (N−2)-th GOA unit.

The pull-down holding module 104 comprises a first pull-down holding unit 1041 and a second pull-down holding unit 1042.

The first pull-down holding unit 1041 comprises a first switching transistor T1, a second switching transistor T2, a third switching transistor T3, a fourth switching transistor T4, a fifth switching transistor T5, a sixth switching transistor T6, and a first capacitor C1.

An control end and an input end of the first switching transistor T1, an input end of the second switching transistor T2, and one end of the first capacitor C1 receive a first clock signal LC1. An output end of the first switching transistor T1 and a control end of the second switching transistor T2 couple to an input end of the third switching transistor T3. An output end of the second switching transistor T2, another end of the first capacitor C1, an input end of the fourth switching transistor T4, a control end of the fifth switching transistor T5, and a control end of the sixth switching transistor T6 couple to a first node K. a control end of the third switching transistor T3 couples to a control end of the fourth switching transistor T4 and the N-th gate signal node Qn. An output and of the third switching transistor, an output end of the fifth switching transistor and an output end of the sixth switching transistor couple to a first voltage line Vss, an output end of the fourth switching transistor couples to a second voltage line L1; an input end of the fifth switching transistor couples to the N-th horizontal scanning line Gn, and an input end of the sixth switching transistor couples to the N-th gate signal node Qn.

The second pull-down holding unit 1042 comprises a seventh switching transistor T7, an eighth switching transistor T8, a ninth switching transistor T9, a tenth switching transistor T10, an eleventh switching transistor T11, a twelfth switching transistor T12, and a second capacitor C2.

A control end and an input end of the seventh switching transistor T7, an input end of the eighth switching transistor T8, and one end of the second capacitor C2 receive a second clock signal LC2; an output end of the seventh switching transistor T7 and a control end of the eighth switching transistor T8 couple to an input end of the ninth switching transistor T9. An output end of the eighth switching transistor T8, another end of the second capacitor C2, an input end of the tenth switching transistor T10, a control end of the eleventh switching transistor T11, and a control end of the twelfth switching transistor T12 couple to a second node P. A control end of the ninth switching transistor T9 and a control end of the tenth switching transistor T10 couple to the N-th gate signal node Qn. An output and of the ninth switching transistor T9, an output end of the eleventh switching transistor T11 and an output end of the twelfth switching transistor T12 couple to a first voltage line Vss. An output end of the tenth switching transistor T10 couples to a third voltage line L2. An input end of the eleventh switching transistor T11 couples to the N-th horizontal scanning line Gn. An input end of the twelfth switching transistor T12 couples to the N-th gate signal node Qn.

The bootstrap capacitor module 105 is an bootstrap capacitor C.

The a voltage amplitude of the first voltage line is greater than voltage amplitudes of the second voltage line and third voltage line.

The first switching transistor T1 and the seventeenth switching transistor T17 are thin film transistor.

Figure 2:
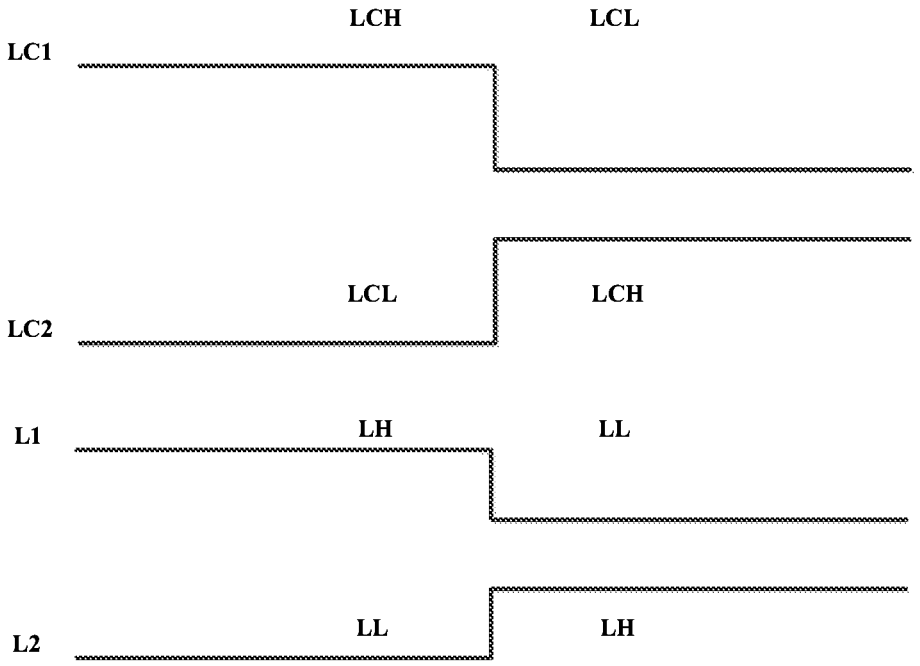
FIG. 2 illustrates a timing diagram of LC1, LC2, L1, and L2 of a preferable embodiment of the GOA driving circuit.

Please refer to FIG. 2, the first clock signal LC1 the second clock signal LC2 have a same cycle and opposite phases. A square waveform signal provided by the second voltage line is inverted to a square waveform signal provided by the third voltage line. The first clock signal LC1 comprises a first low potential LCL and a first high potential LCH. The square waveform signal provided by the second voltage line L2 comprises a second low potential LL and a second high potential LH. The square waveform signal is at the second low potential LL when the first clock signal LC1 is at the first low potential LCL. The square waveform signal is at the second high potential LH when the first clock signal LC2 is at the first high potential.

Figure 3:
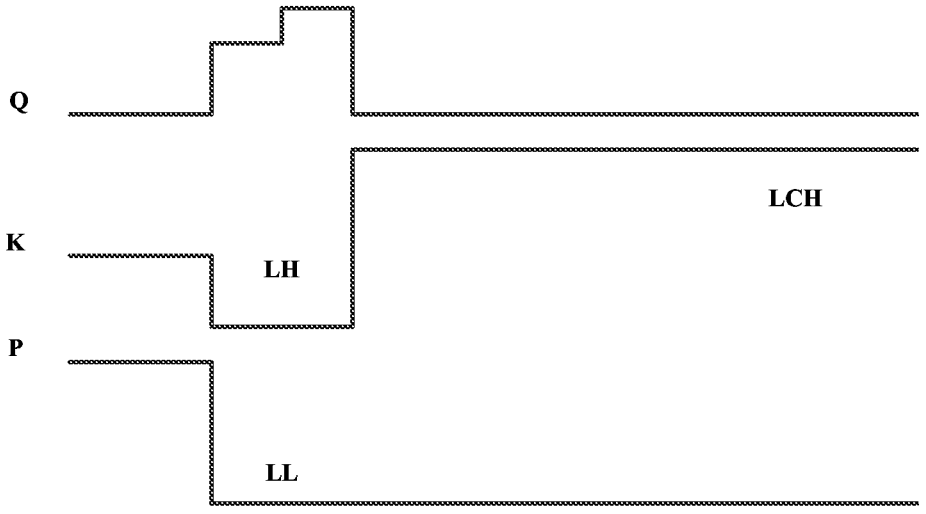
FIG. 3 illustrates a timing diagram of K, P, and Q of a preferable embodiment of the GOA driving circuit.

When LC1 and L1 are at high potential, LC2 and L2 are at low potential, the first pull-down holding unit 1040 works as normally, and the second pull-down holding unit 1042 word abnormally. When the N-th gate signal node Qn is at high potential, the node K will be charged by the High potential LF, the node P will be charged by the low potential LL. When the node Qn is at low potential, the node K will be charged by high potential LCH due to the high potential of LC1, the seventh switching transistor T7 and the eighth switching transistor T8 will be unable to be on as normal due to the low potential of LC2. The node P is utilized to keep the second capacitor C2 in low potential LL as shown in FIG. 3.

Figure 4:
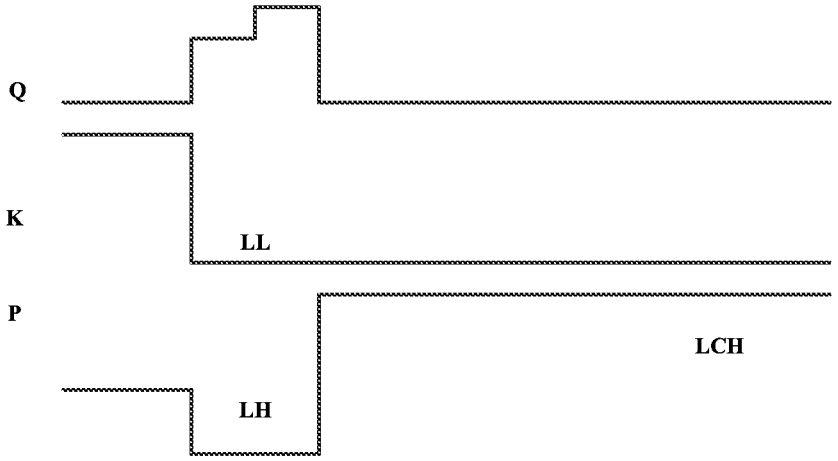
FIG. 4 illustrates another timing diagram of K, P, and Q of a preferable embodiment of the GOA driving circuit.

When LC2 and L2 are at a high potential while LC1 and L1 are at a low potential, the second pull-down holding unit 140 work normally, the first pull-down holding unit 1041 work abnormally. When the gate signal node Qn is at a high potential, the node P will be charged by the high potential LH and the node K will be charged by the low potential LL. When the gate signal node Qn is at a low potential, the node P will be charged by the high potential LCH due to the high potential of LC2. The first switching transistor T1 and the second switching transistor T2 will be unable to be on as normal because LC1 is at a low potential. The node K is utilized to keep the first capacitor C1 in the low potential LL as shown in FIG. 4.

From above-mentioned content, by disposing the first capacitor C1 and the second capacitor C2 on the first pull-down holding unit and the second pull-down holding unit, a forward bias and a reverse bias can be applied on the seventh switching transistor T7, the eighth switching transistor T8, the first switching transistor T1, and the switching transistor T2, so that the invalid of the seventh switching transistor T7, the eighth switching transistor T8, the first switching transistor T1, and the switching transistor T2 could be avoided. Therefore, the stability of the liquid crystal display.

In conclusion, although this disclosure has been disclosed through the preferable embodiments above, the preferable embodiments above are not utilized to limit this disclosure. One having ordinary skills can change and modify without violating the concepts and scope of this disclosure. Therefore, the scope that this disclosure protects is based on the scope defined by the claims.

The invention claimed is:

1. A GOA driving circuit comprising:

a plurality of cascaded GOA units, an N-th GOA unit outputting a gate driving signal to an N-th horizontal scanning line of a display area, wherein the N-th GOA unit comprises a pull-up module, a pull-down module, a pull-up control module, a pull-down holding module, and a bootstrap capacitor module; the pull-up module, the pull-down module, the pull-down holding module, and the bootstrap capacitor module couple to an N-th gate signal node Qn and an N-th horizontal scanning line Gn; the pull-up module couples to the N-th gate signal node Qn;

the pull-down holding module comprises a first pull-down holding unit and a second pull-down holding unit;

the first pull-down holding unit comprises a first switching transistor, a second switching transistor, a third switching transistor, a fourth switching transistor, a fifth switching transistor, a sixth switching transistor, and a first capacitor;

a control end of the first switching transistor, an input end of the first switching transistor, an input end of the second switching transistor, and one end of the first capacitor receive a first clock signal; an output end of the first switching transistor is directly connected to a control end of the second switching transistor and coupled to an input end of the third switching transistor; an output end of the second switching transistor, another end of the first capacitor, an input end of the fourth switching transistor, a control end of the fifth switching transistor, and a control end of the sixth switching transistor couple to a first node K, a control end of the third switching transistor couples to a control end of the fourth switching transistor and the N-th gate signal node Qn; an output and of the third switching transistor, an output end of the fifth switching transistor and an output end of the sixth switching transistor couple to a first voltage line Vss, an output end of the fourth switching transistor couples to a second voltage line L1; an input end of the fifth switching transistor couples to the N-th horizontal scanning line Gn, and an input end of the sixth switching transistor couples to the N-th gate signal node Qn;

the second pull-down holding unit comprises a seventh switching transistor, an eighth switching transistor, a ninth switching transistor, a tenth switching transistor, an eleventh switching transistor, a twelfth switching transistor, and a second capacitor;

a control end of the seventh switching transistor, an input end of the seventh switching transistor, an input end of the eighth switching transistor, and one end of the second capacitor receive a second clock signal; an output end of the seventh switching transistor and a control end of the eighth switching transistor couple to an input end of the ninth switching transistor; an output end of the eighth switching transistor, another end of the second capacitor, an input end of the tenth switching transistor, a control end of the eleventh switching transistor, and a control end of the twelfth switching transistor couple to a second node P, a control end of the ninth switching transistor and a control end of the tenth switching transistor couple to the N-th gate signal node Qn; an output and of the ninth switching transistor, an output end of the eleventh switching transistor and an output end of the twelfth switching transistor couple to a first voltage line Vss, an output end of the tenth switching transistor couples to a third voltage line L2; an input end of the eleventh switching transistor couples to the N-th horizontal scanning line Gn, and an input end of the twelfth switching transistor couples to the N-th gate signal node Qn.

2. The GOA driving circuit according to claim 1, wherein the N-th GOA unit comprises a downlink module comprising a fourteenth switching transistor, an input end of the fourteenth switching transistor receives a clock signal, an output end of the fourteenth switching transistor couples to a control end of a pull-up control module of an (N+2)-th GOA unit, a control end of the fourteenth switching transistor couples to the N-th gate signal node Qn.

3. The GOA driving circuit according to claim 2, wherein the pull-up control module of an (N+2)-th GOA unit comprises a thirteenth switching transistor, an input end of the thirteenth switching transistor couples to an (N−2)-th horizontal scanning line Gn−2, an output end of the thirteenth switching transistor couples to the N-th gate signal node Qn, a control end of the thirteenth switching transistor couples to a output end of a downlink module of an (N−2)-th GOA unit.

4. The GOA driving circuit according to claim 2, wherein the pull-down module comprises a sixteenth switching transistor and a seventeenth switching transistor;

an input end of the sixteenth switching transistor couples to the N-th gate signal node Qn, an output end of the sixteenth switching transistor couples to the first voltage line Vss, an input end of the seventeenth switching transistor couples to the N-th horizontal scanning line Gn, an output end of the seventeenth switching transistor couples to the first voltage line Vss;

a control end of the sixteenth switching transistor and a control end of the seventeenth switching transistor couple to a (N+2)-th horizontal scanning line Gn+2.

5. The GOA driving circuit according to claim 1, wherein the first clock signal and the second clock signal have a same cycle and opposite phases.

6. The GOA driving circuit according to claim 1, wherein a square waveform signal provided by the second voltage line is inverted to a square waveform signal provided by the third voltage line;

the first clock signal comprises a first low potential and a first high potential; the square waveform signal provided by the second voltage line comprises a second low potential and a second high potential; the square waveform signals provided by the second voltage line is at the second low potential when the first clock signal is at the first low potential; the square waveform signals provided by the second voltage line is at the second high potential when the first clock signal is at the first high potential.

7. The GOA driving circuit according to claim 1, wherein the first switching transistor, the second switching transistor, the third switching transistor, the fourth switching transistor, the fifth switching transistor, the sixth switching transistor, the seventh switching transistor, the eighth switching transistor, the ninth switching transistor, the tenth switching transistor, the eleventh switching transistor, and the twelfth switching transistor are thin film transistors.

8. The GOA driving circuit according to claim 1, wherein the pull-up module comprises a fifteenth switching transistor, an input and of the fifteenth switching transistor receives the third clock signal, an output end of the fifteenth switching transistor couples to the N-th horizontal scanning line Gn, a control end of the fifteenth switching transistor couples to the N-th gate signal node Qn.

9. The GOA driving circuit according to claim 1, wherein a voltage amplitude of the first voltage line is greater than voltage amplitudes of the second voltage line and third voltage line.

10. A GOA driving circuit, comprising:

a plurality of cascaded GOA units, an N-th GOA unit outputting a gate driving signal to an N-th horizontal scanning line of a display area, wherein the N-th GOA unit comprises a pull-up module, a pull-down module, a pull-up control module, a pull-down holding module, and a bootstrap capacitor module; the pull-up module, the pull-down module, the pull-down holding module, and the bootstrap capacitor module couple to an N-th gate signal node Qn and an N-th horizontal scanning line Gn; the pull-up module couples to the N-th gate signal node Qn;

the pull-down holding module comprises a first pull-down holding unit and a second pull-down holding unit;

the first pull-down holding unit comprises a first switching transistor, a second switching transistor, a third switching transistor, a fourth switching transistor, a fifth switching transistor, a sixth switching transistor, and a first capacitor;

a control end of the first switching transistor, an input end of the first switching transistor, an input end of the second switching transistor, and one end of the first capacitor receive a first clock signal; an output end of the first switching transistor is directly connected to a control end of the second switching transistor and coupled to an input end of the third switching transistor; an output end of the second switching transistor, another end of the first capacitor, an input end of the fourth switching transistor, a control end of the fifth switching transistor, and a control end of the sixth switching transistor couple to a first node K, a control end of the third switching transistor couples to a control end of the fourth switching transistor and the N-th gate signal node Qn; an output and of the third switching transistor, an output end of the fifth switching transistor and an output end of the sixth switching transistor couple to a first voltage line Vss, an output end of the fourth switching transistor couples to a second voltage line L1; an input end of the fifth switching transistor couples to the N-th horizontal scanning line Gn, and an input end of the sixth switching transistor couples to the N-th gate signal node Qn;

the second pull-down holding unit comprises a seventh switching transistor, an eighth switching transistor, a ninth switching transistor, a tenth switching transistor, an eleventh switching transistor, a twelfth switching transistor, and a second capacitor;

a control end of the seventh switching transistor, an input end of the seventh switching transistor, an input end of the eighth switching transistor, and one end of the second capacitor receive a second clock signal; an output end of the seventh switching transistor and a control end of the eighth switching transistor couple to an input end of the ninth switching transistor; an output end of the eighth switching transistor, another end of the second capacitor, an input end of the tenth switching transistor, a control end of the eleventh switching transistor, and a control end of the twelfth switching transistor couple to a second node P, a control end of the ninth switching transistor and a control end of the tenth switching transistor couple to the N-th gate signal node Qn; an output and of the ninth switching transistor, an output end of the eleventh switching transistor and an output end of the twelfth switching transistor couple to a first voltage line Vss, an output end of the tenth switching transistor couples to a third voltage line L2; an input end of the eleventh switching transistor couples to the N-th horizontal scanning line Gn, and an input end of the twelfth switching transistor couples to the N-th gate signal node Qn;

the N-th GOA unit comprises a downlink module comprising a fourteenth switching transistor, an input end of the fourteenth switching transistor receives a clock signal, an output end of the fourteenth switching transistor couples to a control end of a pull-up control module of an (N+2)-th GOA unit, a control end of the fourteenth switching transistor couples to the N-th gate signal node Qn;

the pull-up control module of an (N+2)-th GOA unit comprises a thirteenth switching transistor, an input end of the thirteenth switching transistor couples to an (N−2)-th horizontal scanning line Gn−2, an output end of the thirteenth switching transistor couples to the N-th gate signal node Qn, a control end of the thirteenth switching transistor couples to a downlink module of an (N−2)-th GOA unit;

the pull-down module comprises a sixteenth switching transistor and a seventeenth switching transistor;

an input end of the sixteenth switching transistor couples to the N-th gate signal node Qn, an output end of the sixteenth switching transistor couples to the first voltage line Vss, an input end of the seventeenth switching transistor couples to the N-th horizontal scanning line Gn, an output end of the seventeenth switching transistor couples to the first voltage line Vss;

a control end of the sixteenth switching transistor and a control end of the seventeenth switching transistor couple to an (N+2)-th horizontal scanning line Gn+2.

11. A liquid crystal display comprising the GOA driving circuit according to claim 1.

* * * * *